US007538683B2

(12) United States Patent
Toloo et al.

(10) Patent No.: US 7,538,683 B2
(45) Date of Patent: May 26, 2009

(54) CONTAINMENT MECHANISM MANIPULATION RESPONSIVE ELECTRICAL CIRCUIT POWER USAGE APPARATUS AND METHOD

(75) Inventors: Mansour Toloo, Palatine, IL (US); Hakeem B. Adewole, Schaumburg, IL (US); Paul W. Brazis, South Elgin, IL (US); Daniel R. Gamota, Palatine, IL (US); Julius S. Gyorfi, Vernon Hills, IL (US); Swee M. Mok, Palatine, IL (US); John B. Szczech, Schaumburg, IL (US); Jie Zhang, Buffalo Grove, IL (US)

(73) Assignee: Motorola, Inc., Schaumburg, IL (US)

( * ) Notice: Subject to any disclaimer, the term of this patent is extended or adjusted under 35 U.S.C. 154(b) by 233 days.

(21) Appl. No.: 11/259,581

(22) Filed: Oct. 26, 2005

(65) Prior Publication Data

US 2007/0090950 A1 Apr. 26, 2007

(51) Int. Cl.
*G08B 21/00* (2006.01)

(52) U.S. Cl. ..... 340/652; 340/541; 340/545.6; 340/550; 340/568.2; 340/571; 340/653; 340/687

(58) Field of Classification Search ..... 340/568.2, 340/568.1, 531, 533, 545.6, 545.7, 650, 652, 340/653, 687, 521, 541, 550, 571; 235/487, 235/492, 375, 376

See application file for complete search history.

(56) References Cited

U.S. PATENT DOCUMENTS

| | | | | |
|---|---|---|---|---|
| 4,329,681 | A | 5/1982 | Parsons | |
| 4,420,745 | A | 12/1983 | Dray et al. | |
| 4,498,077 | A | 2/1985 | Richardson | |
| 4,536,754 | A * | 8/1985 | Holce et al. | 340/568.2 |
| 4,558,306 | A | 12/1985 | Freliech | |
| 4,711,368 | A * | 12/1987 | Simons | 340/545.6 |
| 4,760,382 | A * | 7/1988 | Faulkner | 340/568.2 |
| 6,686,539 | B2 | 2/2004 | Farquhar et al. | |
| 6,963,281 | B2 * | 11/2005 | Buckley | 340/547 |
| 7,119,684 | B2 * | 10/2006 | Petersen et al. | 340/568.1 |

* cited by examiner

*Primary Examiner*—Hung T. Nguyen

(57) ABSTRACT

An object (201) (such as a containment mechanism) supports both a functional electrical circuit (203) and an electrical circuit (202) to which the functional electrical circuit is responsive. In a preferred approach the functional electrical circuit has both a low power state of operation and a higher power state of operation. Upon detecting (104) that an area of connectivity of the electrical circuit has been severed (via, for example, corresponding manipulation of the object itself), the functional electrical circuit responsively operates (106) using the higher power state of operation.

11 Claims, 2 Drawing Sheets

CONTAINMENT MECHANISM MANIPULATION RESPONSIVE ELECTRICAL CIRCUIT POWER USAGE APPARATUS AND METHOD

TECHNICAL FIELD

This invention relates generally to containment mechanisms and more particularly to electrical circuits used in conjunction therewith.

BACKGROUND

Containment mechanisms of various kinds are known in the art including, but not limited to, boxes, envelopes, drawers, trunks, sleeves, cases, and so forth. Such containment mechanisms typically serve to contain one or more items of interest. Such items may be new and intended for distribution and/or sale or may be previously used and intended for storage, moving, resale, or the like. In many cases it may be desired to know and/or be able to respond to when such a containment mechanism is opened, accessed, or otherwise manipulated in some predetermined manner.

For example, in some cases it may be desirable to detect unauthorized access of a given containment mechanism in order to facilitate protecting those corresponding contents. In other cases it may be desired to take a specific action in response to knowing when a particular kind of containment mechanism manipulation has occurred.

Electrical circuits exist that can serve, for example, as an alarm system for a given containment mechanism. Unfortunately, such an approach tends to be relatively costly and tends to find use only with relatively higher-end applications and typically applications that permit reuse of the relatively expensive electrical circuit itself. As a result, numerous application needs remain commercially unmet.

BRIEF DESCRIPTION OF THE DRAWINGS

The above needs are at least partially met through provision of the containment mechanism manipulation responsive electrical circuit power usage apparatus and method described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, an object (such as a containment mechanism) supports both a functional electrical circuit and an electrical circuit to which the functional electrical circuit is responsive. In a preferred approach the functional electrical circuit has both a low power state of operation and a higher power state of operation. Upon detecting that an area of connectivity of the electrical circuit has been severed (via, for example, corresponding manipulation of the object itself), the functional electrical circuit responsively operates using the higher power state of operation.

In an optional though preferred approach the electrical circuit (and preferably the functional electrical circuit as well) is at least partially comprised of printed components including, for example, one or more printed transistors.

So configured, an object such as a containment mechanism of choice can be provided, in a relatively inexpensive manner, with a functional electrical circuit that will respond to one or more predetermined manipulations of the object itself. Such manipulations might include, for example, opening of the object, severing of a portion of the object, closing of the object, and/or otherwise altering a state of being of the object. This, in turn, readily facilitates a wide variety of purposeful actions to respond to the detected manipulation of interest.

These and other benefits will become more evident to those skilled in the art upon making a thorough review and study of the following detailed description.

Figure 1:
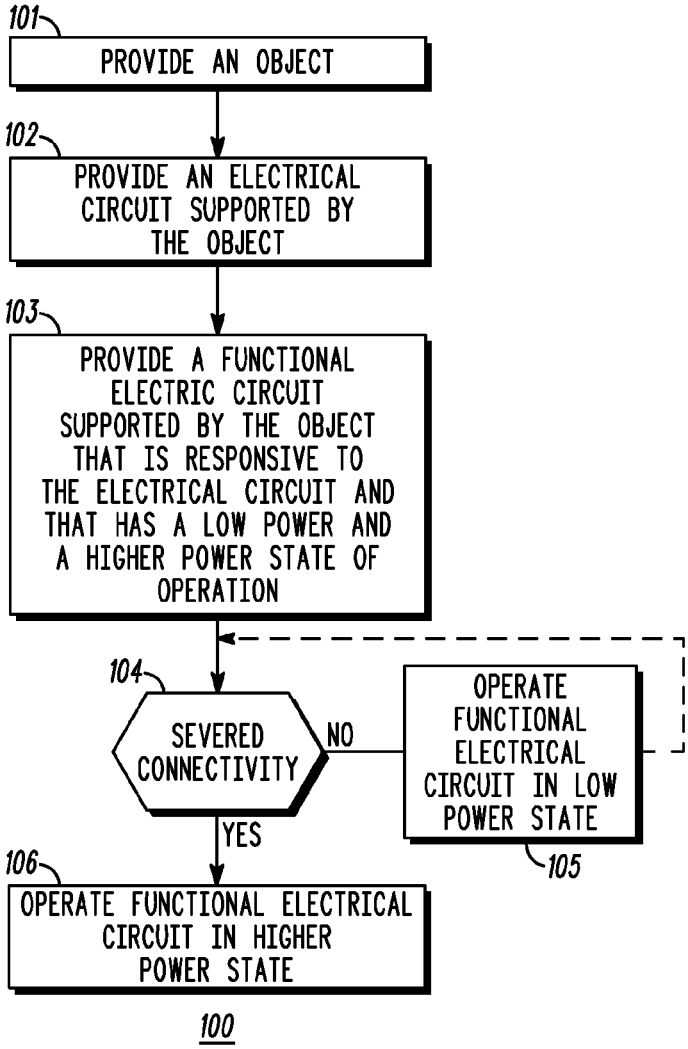
FIG. 1 comprises a flow diagram as configured in accordance with various embodiments of the invention.

Referring now to the drawings, and in particular to FIG. 1, an overall process 100 representative of these various teachings comprises providing 101 an object and further providing 102 an electrical circuit that is supported by that object. The object itself optionally (though preferably) comprises a containment mechanism of choice and more particularly a containment mechanism that serves, at least in part, to retain therein another object or objects of choice. This object can be comprised of any material or materials of choice and can have any desired form factor or size. The electrical circuit may comprise, at least in part, a power supply and may further comprise, if desired, a balanced electrical circuit.

This process 100 further provides for provision 103 of a functional electrical circuit that is also supported by the object. This functional electrical circuit can comprise any of a wide variety of components and/or devices including, but not limited to, an alarm, a display, an active advertisement, an annunciator (for locally stored and/or remotely sourced audio content), an indicator (including visual, audible, and/or haptic indicators), a radio frequency transceiver (including but not limited to a radio frequency identification tag), a sensor, and/or an amusement device of choice, to name but a few. In a preferred approach this functional electrical circuit is operably responsive to the aforementioned electrical circuit and has both a low power state of operation (including but not limited to a no-power state of operation) and a higher power state of operation.

As noted, the electrical circuit and the functional electrical circuit are supported by the object. This will typically comprise physical support of these circuits. By a preferred approach both the electrical circuit and the functional electrical circuit comprise printed electrical circuits and are printed on the object itself. As already noted, the object can comprise any suitable material and this includes various rigid and non-rigid materials. In a preferred embodiment, the object comprises, at least in part, a flexible support surface comprised, for example, of polyester or paper. This support surface can be comprised of a single substantially amorphous material or can comprise, for example, a composite of differentiated materials (for example, a laminate construct). In a typical embodiment the support surface portion of the object will comprise an electrical insulator though for some applications, designs, or purposes it may be desirable to utilize a material (or materials) that tend towards greater electrical conductivity. It may also be desirable to have at least a portion of the support surface portion of the object comprise a readily tearable or otherwise severable material and/or design.

The aforementioned electrical circuit and functional electrical circuit will typically comprise a variety of device elements (such as, but not limited to, resistors, capacitors, transistors, and so forth). These device elements are preferably, though not necessarily, printed using one or more inks including, for example, inks that comprise semiconductor material. Those skilled in the printing arts are familiar with both graphic inks and so-called functional inks (wherein "ink" is generally understood to comprise a suspension, solution, or dispersant that is presented as a liquid, paste, or powder (such as a toner powder). These functional inks are further comprised of metallic, organic, or inorganic materials having any of a variety of shapes (spherical, flakes, fibers, tubes) and sizes ranging, for example, from micron to nanometer. Functional inks find application, for example, in the manufacture of some membrane keypads. Though graphic inks can be employed as appropriate in combination with this process, these inks are more likely, in a preferred embodiment, to comprise a functional ink.

In a preferred approach, such inks are placed on a substrate by use of a corresponding printing technique. Those familiar with traditional semiconductor fabrication techniques such as vacuum deposition will know that the word "printing" is sometimes used loosely in those arts to refer to such techniques. As used herein, however, the word "printing" is used in a more mainstream and traditional sense and does not include such techniques as vacuum deposition that involve, for example, a state change of the transferred medium in order to effect the desired material placement. Accordingly, "printing" will be understood to include such techniques as spraying, screen printing, offset printing, gravure printing, xerographic printing, flexography printing, inkjetting, microdispensing, stamping, and the like. It will be understood that these teachings are compatible with the use of a plurality of such printing techniques during fabrication of a given element such as a semiconductor device. For example, it may be desirable to print a first device element (or portion of a device element) using a first ink and a first printing process and a second, different ink using a second, different print process for a different device element (or portion of the first device element).

For purposes of illustration and not by way of limitation, a transistor can be formed using such materials and processes as follows. A gate can be printed on a substrate of choice using a conductive ink of choice (such as but not limited to a functional ink containing copper or silver, such as DuPont's Ag 5028 combined with 2% 3610 thinner). Pursuant to one approach, air is blown over the printed surface after a delay of, for example, four seconds. An appropriate solvent can then be used to further form, define, or otherwise remove excess material from the substrate. Thermal curing at around 120 degrees Centigrade for 30 minutes can then be employed to assure that the printed gate will suitably adhere to the substrate.

A dielectric layer may then be printed over at least a substantial portion of the above-mentioned gate using, for example, an appropriate epoxy-based functional ink (such as, for example, DuPont's 5018A ultraviolet curable material). By one approach, the dielectric layer comprises a laminate of two or more layers. When so fabricated, each layer can be cured under an ultraviolet lamp before applying a next layer.

Additional electrodes are then again printed and cured using, for example, a copper or silver-based electrically conductive functional ink (such as, for example, DuPont's Ag 5028 with 2% 3610 thinner). These additional electrodes can comprise, for example, a source electrode and a drain electrode. A semiconductor material ink, such as but not limited to an organic semiconductor material ink such as various formulations of polythiophene or a polythiophene-family material such as poly(3-hexylthiophene) or an inorganic semiconductor material ink such as $SnO_2$, SnO, ZnO, Ge, Si, GaAs, InAs, InP, SiC, CdSe, and various forms of carbon (including carbon nanotubes), is then printed to provide an area of semiconductor material that bridges a gap between the source electrode and the drain electrode.

With continued reference to FIG. 1, this process 100 then provides for detecting 104 when an area of connectivity of the electrical circuit has been severed (as may occur, for example, when a corresponding printed portion of the electrical circuit is severed by tearing or the like). So long as this portion remains unsevered, his process 100 will preferably continue to facilitate operation 105 of the functional electrical circuit in the previously mentioned low power state of operation (which may comprise, in some application settings, maintaining the functional electrical circuit in an unpowered state). Upon detecting such severing, however, this process 100 then facilitates responsively causing the functional electrical circuit to operate 106 in the higher power state of operation.

For example, this process 100 can be employed to facilitate provision of an audible alarm if and when a corresponding containment mechanism is opened in such a way as to permit access to the interior of that containment mechanism (where providing this audible alarm comprises the higher power state of operation for the functional electrical circuit). As another example, this process 100 can be employed to facilitate provision of an illuminated poster at such time as the poster is unrolled. For example, the poster may be retained in a rolled-up form factor by a paper band which, when severed, causes operation of an illumination circuit that causes the illumination of the poster itself. Countless other examples are possible and these two specific examples are provided only as non-exhaustive illustrations.

Figure 2:
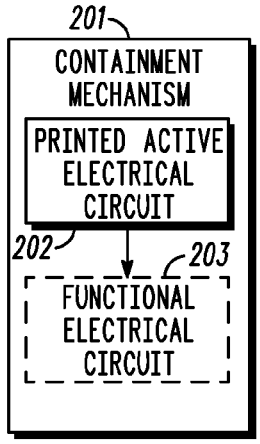
FIG. 2 comprises a block diagram as configured in accordance with various embodiments of the invention.

Viewed generally, and referring now to FIG. 2, these teachings permit provision of an apparatus comprising, for example, a containment mechanism 201 and a printed active electrical circuit 202 that is operably responsive to the containment mechanism 201 and that is further configured and arranged to irreversibly actuate a functional electric circuit 203 in response to detecting at least a predetermined manipulation of the containment mechanism 201. This manipulation can assume many forms including but not limited to opening the containment mechanism, severing a portion of the containment mechanism, closing the containment mechanism, or effecting any other desired alteration of the state of being of the containment mechanism.

Figure 3:
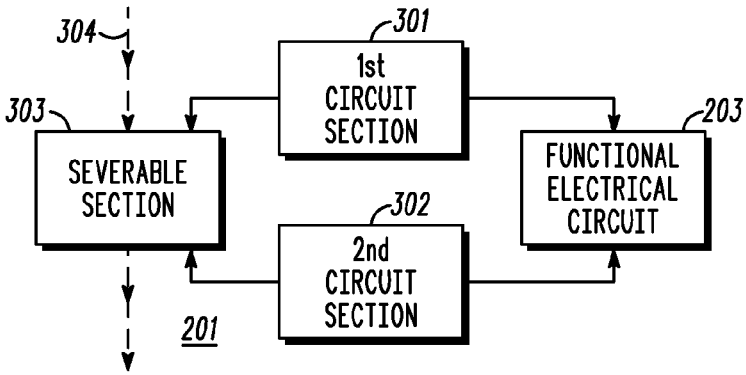
FIG. 3 comprises a block diagram as configured in accordance with various embodiments of the invention.

As mentioned earlier, the electrical circuit can comprise a balanced electrical circuit if desired. So configured, and referring now to FIG. 3, the electrical circuit can itself comprise a first circuit section 301 and a second circuit section 302 that are joined within a severable section 303 of the overall apparatus 201. Either (or preferably, both) of the first and second circuit sections 301 and 302 then preferably operably couple to a functional electrical circuit 203 of choice. So configured, severing a portion of the containment mechanism 201 (along, for example, a preconfigured and/or pre-marked severance line 304) will cause a severing of the intercoupling between the first and second circuit sections 301 and 302 and this, in turn, can give rise to the responsive actions specified above.

Figure 4:
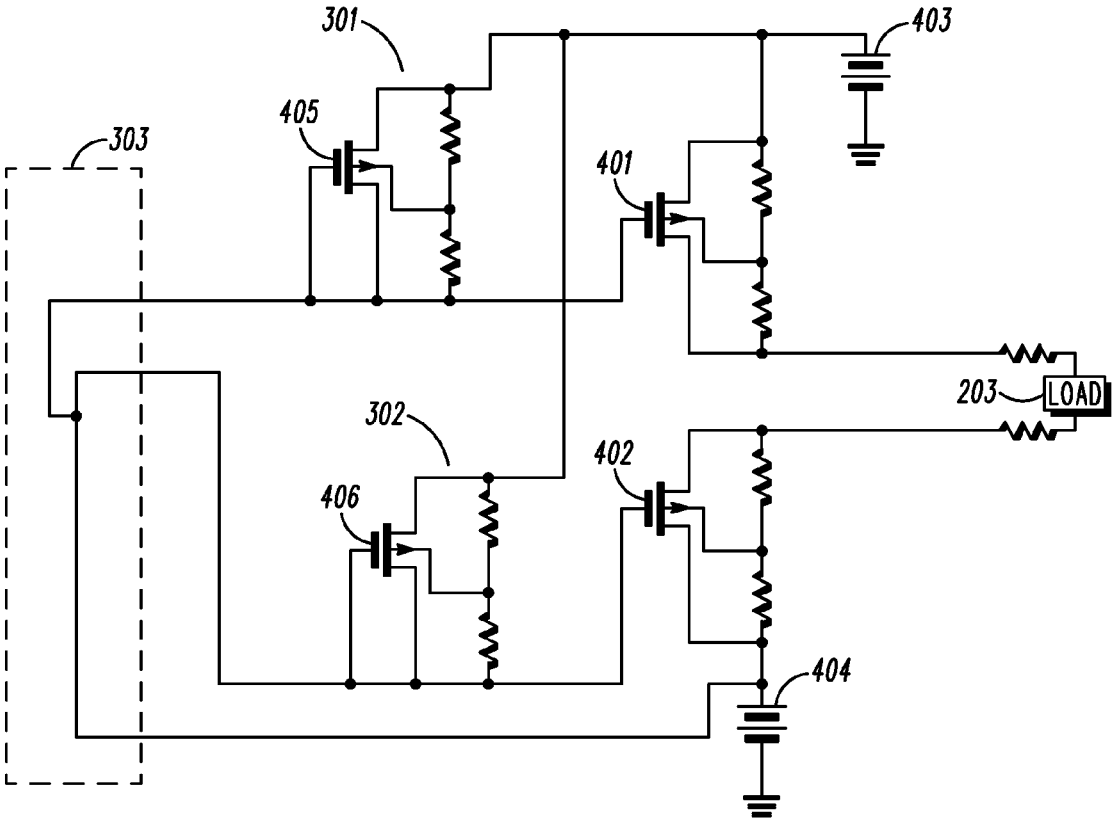
FIG. 4 comprises a schematic view as configured in accordance with various embodiments of the invention.

Referring now to FIG. 4, a specific illustrative instantiation of such a balanced electrical circuit will be described. This example has an electrical circuit comprised of a first circuit section 301 and a second circuit section 302 that are joined within a severable section 303 of the overall apparatus. Both of these circuit sections 301 and 302 in turn are operably coupled to a functional electrical circuit 203 represented here as a LOAD.

In this embodiment, first and second transistors 401 and 402 as each comprise a part, respectively, of the first and second circuit sections 301 and 302 control the flow of power from each of two power supplies 403 and 404, respectively, to the functional electrical circuit 203. While the severable section 303 remains unbroken, the gates of these two transistors 401 and 402 are shorted to the positive power supply. This, in turn, biases both of these transistors 401 and 402 into an OFF state.

Upon severing the interconnection between the first and second circuit sections 301 and 302, however, a negative gate bias voltage is delivered through pull-up loads comprised of third and forth transistors 405 and 406 to the gates of the first and second transistors 401 and 402. This, in turn, biases the first and second transistors 401 and 402 into an ON state which then allows a flow of current to the functional electrical circuit 203.

Such an embodiment, comprised of printed device elements as described above, can serve to provide power to a desired functional electric circuit of choice in response to severing the coupling between the first and second circuit sections 301 and 302, thereby moving the functional electrical circuit 203 from a low power state of operation to a higher power state of being. Other arrangements could of course be accommodated, but a balanced circuit approach offers numerous advantages and benefits well suited to many application settings.

These teachings are readily employed with any of a wide variety of objects including any number of containment mechanisms. If desired, more than one such electrical circuit can be provided to thereby provide, for example, discrete detection and response to particular manipulations of differing parts of a given object. Similarly, more than one functional electrical circuit can be provided if desired, with such multiple functional electrical circuits being each individually responsive to separate corresponding electrical circuits if desired or with multiple functional electrical circuits being responsive to a single shared electrical circuit depending upon the needs of a given application setting. These teachings are well suited to use with printed electrical components and are therefore supportive of economical deployments.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus comprising: an object comprised of paper; a balanced electrical circuit supported by the object, wherein the balanced electrical circuit comprises a printed electrical circuit comprising at least one active circuit element which having a transistor and at least two resistors;

a functional electrical circuit that is operably coupled to the electrical circuit and that has a low power state of operation and a higher power state of operation; an external even trigger supported by the object and serving, when triggered, to irreversibly sever a portion of the balanced electrical circuit and thereby automatically cause the functional electrical circuit to irreversibly operate using the higher power state of operation rather than the low power state of operation.

2. The apparatus of claim 1 wherein the object comprises a containment mechanism.

3. The apparatus of claim 1 wherein the functional electrical circuit comprises a printed functional electrical circuit comprising at least one active circuit element.

4. The apparatus of claim 1 wherein the external event trigger is configured and arranged to respond to manipulation by a human hand, such that the manipulation by a human hand comprises the external event.

5. The apparatus of claim 1 wherein the external event trigger is configured and arranged to respond to a breaking of an area of electrical conductivity.

6. The apparatus of claim 1 wherein the object comprises a containment mechanism and wherein the external event trigger responds to an external event comprising accessing the a containment mechanism.

7. The apparatus of claim 1 wherein the functional electrical circuit comprises at least one of:

an alarm;
a display;
an advertisement;
an annunciator;
an indicator;
a radio frequency transceiver;
a sensor;
an amusement device.

8. A method comprising: providing an object comprised of paper; providing an electrical circuit having at least one active circuit element by printing the electrical circuit on the object which comprising a transistor and at least two resistors; providing a functional electrical circuit supported by the object and that is operably responsive to the electrical circuit and that has a low power state of operation and a higher power state of operation; operating the functional electrical circuit in the low power state of operation; detecting when an area of connectivity of the electrical circuit is severed and then responsively causing the functional electrical circuit to operate in the higher power state of operation.

9. The method of claim 8 wherein providing a functional electrical circuit comprises printing the functional electrical circuit.

10. The method of claim 8 wherein detecting when an area of connectivity of the electrical circuit is severed comprises detecting when a printed portion of the electrical circuit is severed.

11. The method of claim 8 wherein providing an electrical circuit comprises, at least in part, a power supply.

* * * * *